US005232029A

United States Patent [19]

Knox et al.

[11] Patent Number: 5,232,029

[45] Date of Patent: Aug. 3, 1993

[54] ADDITIVE DEVICE FOR VIAL

[75] Inventors: Kenneth H. Knox, Libertyville; Robert S. Schlaupitz, Wadsworth, both of Ill.

[73] Assignee: Abbott Laboratories, Abbott Park, Ill.

[21] Appl. No.: 951,364

[22] Filed: Sep. 25, 1992

Related U.S. Application Data

[63] Continuation of Ser. No. 624,361, Dec. 6, 1990, abandoned.

[51] Int. Cl.[5] ..... B65B 3/04

[52] U.S. Cl. ..... 141/329; 141/383

[58] Field of Search ..... 141/27, 97, 312, 329, 141/330, 369, 370, 371, 383, 384, 385, 386

[56] References Cited

U.S. PATENT DOCUMENTS

| | | | |
|---|---|---|---|
| 3,547,122 | 12/1970 | Rider . | |
| 3,739,779 | 6/1973 | Pfleger . | |
| 3,811,441 | 5/1974 | Sarnoff . | |
| 3,870,044 | 3/1975 | Burke et al. . | |
| 3,946,732 | 3/1976 | Horscham . | |
| 3,999,543 | 12/1976 | Lacey | 141/329 X |
| 4,196,732 | 4/1980 | Wardlaw | 141/330 X |
| 4,203,443 | 5/1980 | Genese | 141/329 X |
| 4,312,349 | 1/1982 | Cohen | 141/329 X |
| 4,564,054 | 1/1986 | Gustavsson . | |
| 4,607,671 | 8/1986 | Palto et al. . | |
| 4,614,437 | 9/1986 | Buehler . | |
| 4,826,489 | 5/1989 | Haber et al. . | |
| 4,834,149 | 5/1989 | Fournier et al. | 141/329 X |
| 4,834,152 | 5/1989 | Howson et al. | 141/329 X |
| 4,986,322 | 1/1991 | Chibret et al. | 141/329 X |

*Primary Examiner*—William A. Cuchlinski, Jr.
*Assistant Examiner*—G. Bradley Bennett
*Attorney, Agent, or Firm*—A. Nicholas Trausch

[57] ABSTRACT

An adapter has a cannula to deliver a drug to the interior of a vial. The vial contains a plunger that has a penetratable self-sealing rubber diaphragm, as is common. The adapter comprises a barrel adapted to fit over and telescope onto the vial, with a cannula rigidly mounted axially in the barrel and long enough to reach the bottom of the vial after penetrating the rubber diaphragm. The barrel incorporates fins that stabilize the cannula axially. Cover plugs are provided to close both the barrel and the vial before use. When the covers are removed and the barrel s fitted down over the vial, the cannula projects beyond the fins to penetrate the plunger and push the plunger to the bottom of the vial. The long barrel and the rigidly maintained cannula insure that the cannula cannot contact the inner wall of the vial.

9 Claims, 1 Drawing Sheet

ADDITIVE DEVICE FOR VIAL

This application is a continuation of application Ser. No. 07/624,361, filed Dec. 6, 1990 now abandoned.

BACKGROUND OF THE INVENTION (a) Field of the Invention

This invention relates to the broad field of transfer of liquids while maintaining their sterility and freedom from contamination. More particularly, it relates to the field of filling vials with liquid such as an analgesic for subsequent injection into a patient. Specifically, this invention relates to an adapter for use in the injection of a liquid into a vial while maintaining the sterility of the liquid and of the surfaces of the vial contacted by the liquid.

It has been conventional to provide a vial filled with a liquid for transfer to an injector. Typically the vial is pre-filled at the factory that produces the vial. This standard injector vial arrangement includes a vial body having a cylindrical wall between open and closed ends. A plunger is slidable between the ends while maintaining fluid-tight contact with the cylindrical wall. When the vial is pre-filled, the plunger is near the open end, cooperating with the vial to enclose the liquid.

The plunger has an externally threaded stub projecting toward the open end of the vial. The vial is used with an injector that has a needle that extends all the way through it with a removable cap covering the needle at one end. The other end of the injector body has internal threads that enable it to be threaded onto the externally threaded stub of the vial plunger. As the threaded end of the injector body is threaded into the stub, the point of the needle penetrates the plunger and into the liquid volume.

Upon removal of the cap at the other end of the injector, an injection can be given. The injector body has lateral finger wings that facilitate drawing the injector body toward the vial, pressing the plunger away from the open end of the vial body and pushing the liquid through the needle into the patient.

A need has developed for vial that can be supplied empty to be filled subsequently, such as by a pharmacist. This invention provides an adapter to accommodate such subsequent filling of a vial. In the unfilled vial, which is shipped empty, the plunger is adjacent the closed end of the vial, remote from the open end. There is a removable cap the open end of the vial body. This adapter incorporates a transfer syringe for filling the vial while preventing any contaminating contact with the inner wall of the vial that will come into contact with the liquid a the vial is filled and the plunger is driven toward the open end.

(b) Review of Prior Art

Of the prior art examples that deal with means to fill an ampule from a vial, most have a portion connectable with the liquid-holding receptacle, which is full, and have mechanism to expel the liquid from the receptacle and discharge it into a patient. Means are incorporate to keep the liquid uncontaminated during the time it is transferred from the ampule to the patient or to another location.

The typical prior dispensing arrangement consists of a receptacle such as an ampule or a vial that has a cannula assembly extending into it from one end. Adjacent that end is a plunger and the liquid to be dispensed is on the inside end of the plunger. The cannula is supported so that it can be projected through a rubber seal on the piston whereupon liquid can be dispensed through the cannula by the application of pressure to the liquid, by squeezing or other known means. When the piston has been pushed all the way to the closed end of the ampule, the liquid has been dispensed through the cannula.

In Rinser patent No. 3,547,122 the cannula cannot come near the piston. The liquid is already present in the ampule to be ejected therefrom. There is no cannula and no barrel surrounding the cannula. Pfleger U.S. Pat. No. 3,739,779 also lacks a long cannula and a piston that is penetrated to permit introduction of liquid on the closed side of the piston. Sarnoff U.S. Pat. No. 3,811,441 discloses an elongated cylinder surrounding an ampule, but the patent discloses a cannula that is relatively short and that does not connect to the piston. There is no means for penetrating the piston or for holding the liquid behind the piston.

Burke U.S. Pat. No. 3,870,044 provides a short stroke for its cannula. The device of the Burke patent is designed to have the cannula and associated parts broken off after a single use. There is no means by which the cannula could be extended through a piston. Hurscham U.S. Pat. No. 3,946,732 discloses a means for transferring liquid from one chamber to another for mixing with a solid or other liquid. There is a cylinder that has a member that can be penetrated by a cannula. The patent discloses two separate chambers with means for interconnecting them.

The Larrabee U.S. Pat. No. 3,993,063 is directed to the unloading of a vial and for filling a vial. The patent discloses an outer cylinder but does not include a plunger that is movable from the closed end of a vial receptacle. Gustavsson U.S. Pat. No. 4,564,054 discloses a device for transferring a substance from one vessel to a second vessel and for preventing air contamination. The patent does not provide an adapter for the purpose of the present invention.

Buehler U.S. Pat. No. 4,614,437 discloses no piston that is penetrated. Haber U.S. Pat. No. 4,826,489 discloses a needle in a sheath, but there is no plunger arrangement by which a liquid may be inserted into an ampule. The Haber device is for the delivery of a liquid rather than for the filling of a vial. Tripp U.S. Pat. No. 4,614,515 relates to a delivery system for delivering a liquid from a vial.

SUMMARY OF THE INVENTION

The invention provides an elongated cannula sheltered by a barrel sleeve. The barrel sleeve is of larger diameter than that of the vial and preferably is somewhat longer to enable the barrel sleeve to fit about the outer wall of the vial and slide along its outer surface as a guide. The cannula is held rigidly to the center of the barrel sleeve. When the barrel sleeve is fitted over the end and moved downwardly on the vial, the cannula is driven against a conventional plunger within the vial and forces the plunger toward the closed end of the vial.

The conventional plunger has a penetratable diaphragm or the like as is conventional. As the cannula presses against the plunger, it penetrates the plunger, expelling air from beneath the plunger and allowing the plunger to approach the closed end of the vial. Thereafter, the filter can be removed and connection can be made between the cannula and a source of the liquid that is to be injected into the vial, whereupon liquid may be forced through the cannula into the bottom of the vial. As the liquid enters the vial, the expanding liquid volume forces the plunger toward the open end of the vial until the vial is filled.

DETAILED DESCRIPTION OF THE PREFERRED EMBODIMENT

Figure 2:
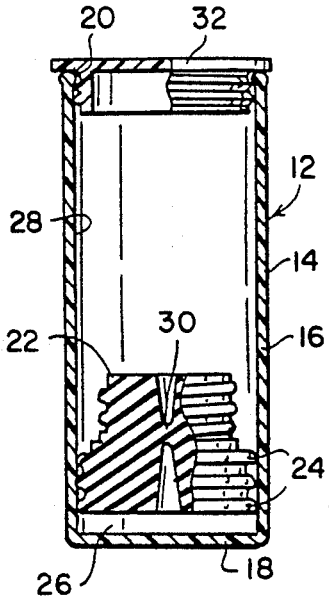
FIG. 2 is an elevation view of a vial in longitudinal medial section.
Figure 3:
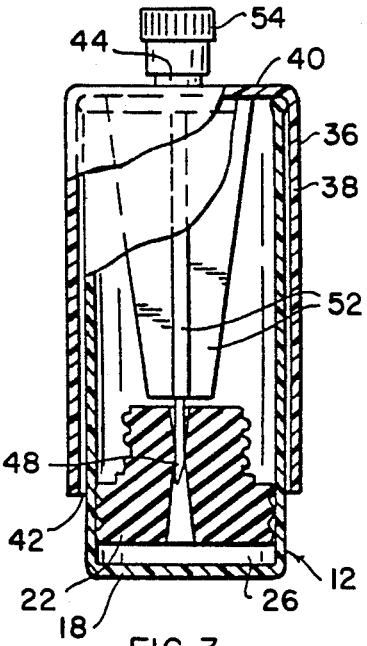
FIG. 3 is an elevation view of the adapter and the vial illustrating an intermediate operating condition.

The adapter 10 of this invention is for use in connection with filling a conventional vial 12 of the kind illustrated in FIG. 2. The conventional vial 12 has a vial body 14 having a cylindrical side wall 16 extending between a closed end 18 and an open end 20. A plunger 22 is slidable within the side wall 16 of the vial body 14. The plunger has annular ribs 24 for maintaining a fluid-tight seal against the inner surface of the cylindrical side wall 16, separating the side wall 16 into a liquid chamber area 26 and an external area 28. The relative sizes of the two areas 26 and 28 depend upon the axial position of the plunger 22. The plunger 22 has a diaphragm 30 that can be penetrated by the pointed end of a cannula.

Figure 5:
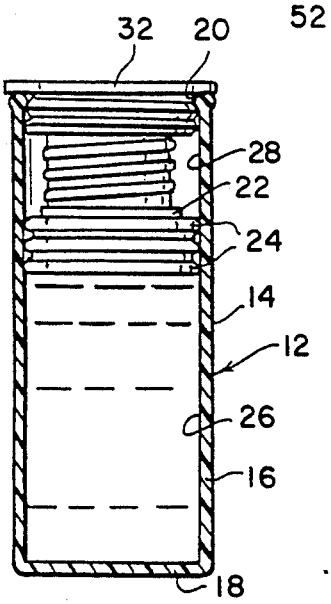
FIG. 5 is an elevation view of the vial in longitudinal medial section illustrating the filled condition.

If the vial 14 was filled with a pharmaceutical solution, the plunger 22 would be near the open end 20, as illustrated in FIG. 5. For purposes of the present invention, the vial 12 will have been shipped or otherwise delivered empty and the plunger 22 will be adjacent the closed end 18 of the vial body 14 (shown in FIG. 2). In this condition, it is important that the external surface area 28 within the side wall 16 be kept free of any contamination, because upon filling the vial, the area 28 will come into contact with the pharmaceutical solution.

To maintain freedom from contamination for the period prior to use of the vial 12, a plug cover 32 is provided, as is conventional, and the plug cover 32 maintains a sterile seal until it is removed.

Figure 1:
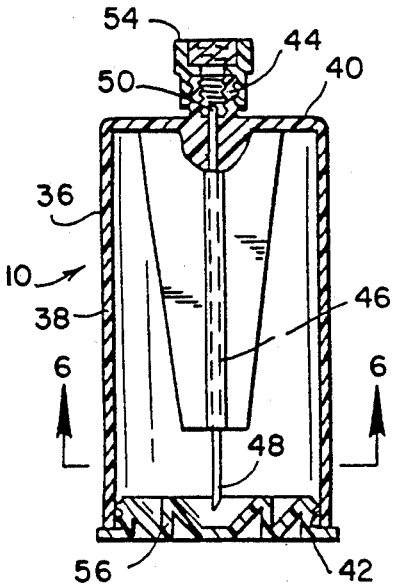
FIG. 1 is an elevation view of the adapter in longitudinal medial section.

Referring to FIG. 1, the adapter 10 incorporates a barrel 36 defined by a cylindrical sleeve 38 extending between a closed end 40 and an open end 42. A stub 44 projects from and is integral with the closed end 40.

Figure 6:
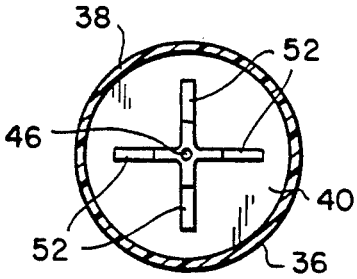
FIG. 6 is a view in section taken along the plane of the line 6—6 of FIG. 1.

A cannula 46 extends through the closed end 40 of the barrel 36. The cannula 46 has a pointed injection end 48 located just inside the open end 42 of the barrel 38. An inlet end 50 of the cannula is positioned within the stub 44. The cannula 46 is held in a generally rigid position on the axis of the cylindrical wall 36 by a plurality of fins 52 that are molded integrally with and extend from the closed end 40, as shown in FIGS. 1 and 6.

An air filter 54 is removably connected to the stub 44 such as by a threaded connection, to filter any air entering the inlet end 50 of the cannula 46. A removable plug cover 56 maintains sterility at the open end 42 of the barrel 36.

Figure 4:
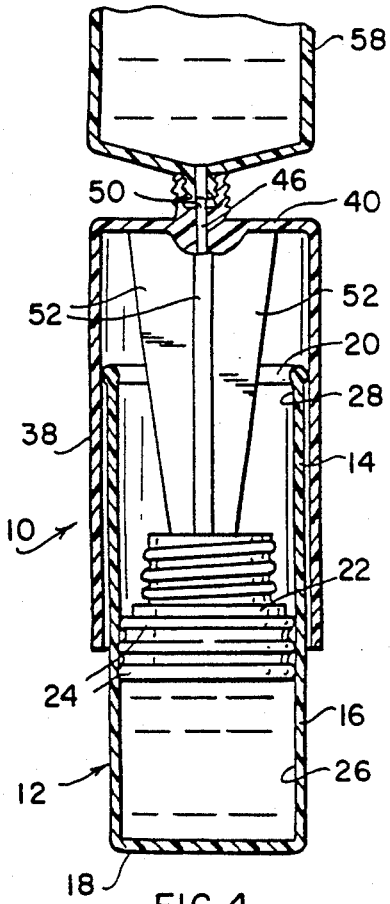
FIG. 4 is an elevation view of the adapter and the vial in longitudinal medial section illustrating another intermediate operating position.

When the air filter 54 is removed, a transfer syringe or other suitable source of a liquid drug can be mounted on the stub 44, as is shown in FIG. 4 by a threaded connection, a Luer lock, a Luer taper connection or any type of seal. In such position, the transfer syringe 58 can introduce a liquid drug into the inlet end of the cannula 46.

In Use

This adapter 10 is used to fill a vial 12 having its plunger 22 adjacent the closed end 18. The plug cover 32 protects the vial from the introduction of any contaminating foreign matter or object. Likewise, the barrel 36 and plug cover 56 protect the cannula 46 from any contaminating contact. A user first removes the plug cover 32 from the vial 12 and the plug cover 56 from the adapter barrel 36.

The user slides the barrel 36 over the vial body 14 until the injection end 48 of the cannula 46 can penetrate the diaphragm 30 of the plunger 22. The side wall 38 of the barrel 36 slides in a loose fit over the side wall 16 of the vial body 14, guiding the cannula along the axis of the vial as the barrel is kept in a coaxial relationship to the vial. The fins 52 hold the cannula in a centered position and the telescoping connection between the barrel and the vial prevents contact with the inner wall surface 22 by either the cannula 46 or the fins 52.

The cannula may penetrate until the lower ends of the fins 52 engage the plunger 22. The foregoing action pushes the plunger down, forcing air back through the cannula and out through the air filter 54. This continues until the plunger is adjacent the closed end 18 of the vial.

The cannula is maintained stiffly centered within the barrel sleeve by the fins 52. The barrel 36 and the vial body 14 are of the same outside shape, usually cylindrical. The fit of the barrel over the vial should not be airtight, and will permit escape of some air from above the plunger 22 as the plunger rises in the vial. The barrel sleeve is always long enough in an axial direction to protect and shelter the projecting end of the cannula that penetrates the plunger.

Next, the user removes the air filter 54 and attaches a transfer syringe 58 to the exposed inlet end or luer taper 50 and fills the vial with the desired liquid. During filling, the liquid flows under the plunger 22 and forces it up, carrying the cannula 46 with it. This results in liquid contact with the inner surface area 28 that previously had been on the external side of the plunger 22, but now becomes part of the area 26 defining the liquid chamber. Nevertheless, this surface area 28 has remained sterile because the adapter 10 has prevented any contact with the surface area 28.

When all the liquid is delivered into the vial, the adapter 10 is removed, the vial 12 is re-capped, and can be used as needed. Normally, the adapter 10 and associated parts will be discarded.

The barrel 36 can be made of a variety of suitable plastics such as polypropylene. The plug covers caps on the vial and the adapter can be of polyethylene. The plunger 22 is normally made of a rubber material or a dimeric one and is a standard vial plunger.

The invention provides a filling device for filling vials that will maintain complete sterility of the product, even when the filling is performed away from the manufacturing source. Thus, a druggist or hospital nurse may fill vials without losing their sterility. The invention involves an elongated cannula that can extend from the open end to adjacent the bottom of the vial. That cannula is supported within the barrel sleeve that can slide freely over the outside of the vial.

There are various changes and modifications which may be made to the invention as would be apparent to those skilled in the art. However, these changes or modifications are included in the teaching of the disclosure, and it is intended that the invention be limited only by the scope of the claims appended hereto.

What is claimed is:

1. An adapter for the transfer of liquid to an empty vial while maintaining the sterility of the liquid contact surface of the vial which comprises:

a barrel sleeve adapted to fit down over the vial, the barrel sleeve having a closed upper end and an open lower end, an elongated cannula extending from the closed end of the barrel sleeve toward the open end thereof whereby to penetrate a plunger in eh vial that is located adjacent the closed lower end of the vial and which has an axially pierceable central diaphragm, the barrel sleeve being substantially the same length as the cannula in order to protect the cannula from engaging any contaminated parts of the equipment during its use, the cannula being maintained substantially coaxially within the barrel sleeve.

2. The adapter of claim 1 wherein:

there are fins disposed about the cannula to maintain it in its axial position, the fins extending along the cannula a sufficient distance to maintain the cannula in its axial position both before use and during use, the cannula extending beyond the fins with a section adapted to penetrate the plunger.

3. The adapter of claim 1 with a cap adapted to close the open lower end of the sleeve before use, whereby to maintain its sterility, the cap being removable at the time of use.

4. The adapter of claim 1 wherein the cannula opens through a removable air filter in the closed upper end of the barrel sleeve to enable air to be expelled from below the pierceable plunger when the cannula is inserted therethrough.

5. The adapter of claim 1 wherein the vial has a side wall and the plunger is slidable therein with its pierceable diaphragm being penetratable by the cannula, the barrel sleeve being of a shape and size to slide over the side wall of the vial and guide the cannula through the vial free from contact with the inner surface of the vial side wall prior to penetration of the diaphragm of said plunger.

6. The adapter of claim 5 with a removable cap to close the vial prior to its use.

7. An adapter for transferring fluid from a fluid source into a vial, the vial having a closed end, a continuous sidewall, an open end and a pierceable plunger sealingly slideable within the sidewall to define an enclosed variable volume fluid chamber with the closed end of the of the vial, the adapter comprising:

a sleeve member having an open end, a closed end and a sleeve portion having an interior surface such that the open end and interior surface of the sleeve portion telescopingly fit over the open end and sidewall of the vial;

fluid inlet means at the closed end of the sleeve member for connection to the fluid source;

a cannula coaxially extending within the sleeve member and having a first end mounted in the closed end of the sleeve member in fluid communication with the fluid inlet means and a second end axially ending within the interior surface of the sleeve portion; and axially extending support means coaxially surrounding a portion of the cannula and extending from the closed end of the sleeve member to a truncated end axially along the cannula so that an unsurrounded portion of the cannula can penetrate the pierceable plunger when the truncated end of the support means abuts the plunger sot hat when fluid is delivered through the cannula into the variable volume fluid chamber in the vial, the plunger, the support means and the sleeve member move toward the open end of the vial.

8. The adapter of claim 7 further including radial clearance between the support means and the interior surface of the sleeve member.

9. The adapter of claim 7 wherein the support means is a plurality of axial ribs surrounding the cannula.

* * * * *